United States Patent [19]

Elmore

[11] 4,036,131

[45] July 19, 1977

[54] DAMPENER

[75] Inventor: Donald Fenton Elmore, Xenia, Ohio

[73] Assignee: Harris Corporation, Cleveland, Ohio

[21] Appl. No.: 610,735

[22] Filed: Sept. 5, 1975

[51] Int. Cl.[2] ..... B41F 13/24

[52] U.S. Cl. ..... 101/247; 101/148; 101/425

[58] Field of Search ..... 101/142, 147, 148, 247, 101/425

[56] References Cited

U.S. PATENT DOCUMENTS

| | | | |
|---|---|---|---|
| 3,673,959 | 7/1972 | Jezuit et al. | 101/425 |
| 3,701,316 | 10/1972 | Sylvester et al. | 101/425 |
| 3,771,450 | 11/1973 | Cleybergh | 101/425 |
| 3,783,782 | 1/1974 | Hardt | 101/247 |
| 3,842,735 | 10/1974 | Sontham et al. | 101/148 |
| 3,850,099 | 11/1974 | Laben | 101/425 |

*Primary Examiner*—Edgar S. Burr
*Assistant Examiner*—William Pieprz

[57] ABSTRACT

A dampener form roll has a wash-up position in which the dampener form roll is in fluid-transferring relationship with the ink form roll so that when wash-up fluid is applied to the ink form roll, it is transmitted to the dampener form roll, and thus effects a clean-up of the ink on the dampener form roll. A throw-off mechanism is provided for moving the dampener form roll between thrown-on and thrown-off positions, and that throw-off mechanism includes a motor having a reciprocating output member connected with a linkage for transmitting the motion of the output member to the dampener form roll. Means is located in the linkage for disabling the linkage so that it is disconnected, thus disconnecting the dampener form roll from the motor. A spring is provided for moving the dampener form roll to its wash-up position upon disconnection of the linkage. Further, the dampener form roll is gear driven through a gear train from the plate cylinder of the printing press and on movement to the wash-up position, one gear for driving the dampener form roll moves out of engagement with its cooperating gear so that the teeth thereof are out of meshing engagement.

7 Claims, 8 Drawing Figures

DAMPENER

BACKGROUND OF THE PRESENT INVENTION

The present invention relates to dampeners for lithographic printing presses. Dampeners are used in lithographic printing presses for applying a dampening solution to the printing plate carried by the plate cylinder of the lithographic press. After the dampening solution is applied to the plate, the inker applies the ink to the plate. As is well known, a lithographic printing plate has ink-receptive areas which reject dampening solution and dampening-solution receptive areas which are ink rejecting. The dampening solution is applied to the plate by a form roll.

As is well known in the art, as the printing is effected the dampener form roll tends to pick up ink from the plate. During clean-up of the printing press, it is desirable to remove the ink that is not only in the inker, but also the ink which may have become deposited on or picked up by the dampener form roll. Prior art patents have been directed to the problem of providing for dampener form roll clean-up simultaneously with the inker clean-up or wash-up. Typical of the known art for providing for dampener form roll wash-up in combination with the inker wash-up is shown in U.S. Pat. Nos. 3,842,735 and 3,701,316, both of which are assigned to the assignee of the present invention.

SUMMARY OF THE PRESENT INVENTION

The present invention is directed to a dampener, and particularly a dampener which provides for wash-up of the dampener form roll in combination with wash-up of the inker. In essence, the present invention includes a dampener form roll which is capable of being positioned in three different positions, namely, a thrown-on position in which the dampener form roll is in dampener-solution transferring relationship with the plate cylinder, a thrown-off position in which the dampener form roll is out of fluid-transferring relationship with the plate cylinder, and a wash-up position in which the dampener form roll is in fluid-transmitting relationship with an ink form roll, which ink form roll is in a thrown-off position. The dampener form roll of the present invention is gear driven from the printing plate cylinder through a gear train which includes a gear carried on the dampener form roll shaft. During movement of the dampener form roll between its thrown-on and thrown-off positions, the meshing teeth of the gears of that gear train are maintained in driving engagement, so that when the dampener form roll is in its thrown-off position, it may be rotated by the intermeshing gear teeth of the gear carried on the shaft of the dampener form roll and its cooperating gear. However, when the dampener form roll is moved to its wash-up position in fluid-transmitting relationship with the ink form roll, the gear on the dampener form roll shaft becomes completely disengaged from its cooperating gear.

In accordance with the present invention, the dampener form roll, as is conventional, is moved by a throw-off mechanism between its thrown-on and thrown-off positions. A suitable motor having a reciprocable output member is provided and a linkage is interposed between the output member and the dampener form roll. Upon actuation of the motor the linkage effects movement of the dampener form roll between its thrown-on and thrown-off positions, depending upon the direction of movement of the motor. A means is provided in the linkage so as to effect disablement or disconnection of the linkage and thereby render the throw-off mechanism inoperative to move the dampener form roll. A spring arrangement is provided which, upon disablement of the linkage, moves the dampener form roll into its wash-up position in fluid transmitting relation with the ink form roll. The spring will cause movement of the teeth of the gear on the dampener form roll shaft out of engagement with the teeth of its cooperating gear, so as to completely disconnect the dampener form roll drive from the plate cylinder. Accordingly, in the wash-up position, the dampener form roll is driven by the pressure engagement it may have with the ink form roll. When it is desired to move the dampener form roll from its wash-up position, the dampener form roll is manually moved against the bias of the spring into a position where the throw-off mechanism or more specifically, the linkage can be enabled or reconnected. During this action, the gear on the dampener roll shaft for driving the dampener roll must be re-engaged with its cooperating gear which re-effects the driving engagement between the dampener roll and the cooperating gear for driving the dampener roll. To effect this re-engagement of the gear teeth, it may be necessary to manually align the gear on the dampener roll shaft with its cooperating gear by slight rotation thereof.

DESCRIPTION OF THE FIGURES

Further features and advantages of the present invention will be apparent to those skilled in the art to which it relates from the following detailed description of a preferred embodiment of the present invention made with reference to the accompanying drawings, in which.

DESCRIPTION OF A PREFERRED EMBODIMENT

As noted hereinabove, the present invention is directed to a dampener for use in a lithographic printing press. In a lithographic printing press a dampener applies dampening solution to the printing plate prior to the printing plate receiving ink form the inker. It should be well understood that the specific structure of the printing press to which the present invention applies may vary. Likewise the inker and dampener mechanism may vary. As representative of the present invention, the present invention is shown and illustrated as being applied to a offset lighographic printing press 10.

Figure 5:
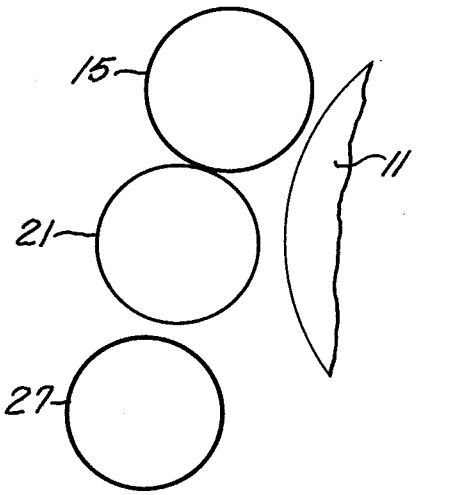
Figure 5A:
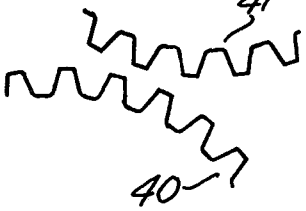

The lithographic printing press 10 includes a plate cylinder 11 which carries a printing plate and which applies an image to a blanket cylinder 12. The blanket cylinder 12 contacts the material being printed and prints the image on the material. The plate cylinder 11 is adapted to carry a lithographic printing plate. A conventional inker mechanism applies ink to the printing plate carried on the plate cylinder 11. The inker meachanism includes an ink form roll 15 and an ink-transferring roll 16, which only comprise a part of the inker for applying ink to the plate. A suitable throw-off mechanism, generally designated 17 is provided for throwing the inker form roll 15 between its ink-transferring position, shown in full lines in FIG. 1, to a thrown-off position out of ink-transferring relationship with the printing plate on the plate cylinder 11. The thrown-off position of the ink form roll 15 is shown in FIG. 5. The specific structure of the throw-off mechanism 17 does not form a part of the present invention. As merely representative, a cam 18 which is rotated moves a link 19 to pivot link 19*a* about the axis of the roll 16. The link 19*a* carries the ink form roll between its thrown-on and thrown-off position upon movement of the cam 18.

Figure 1:
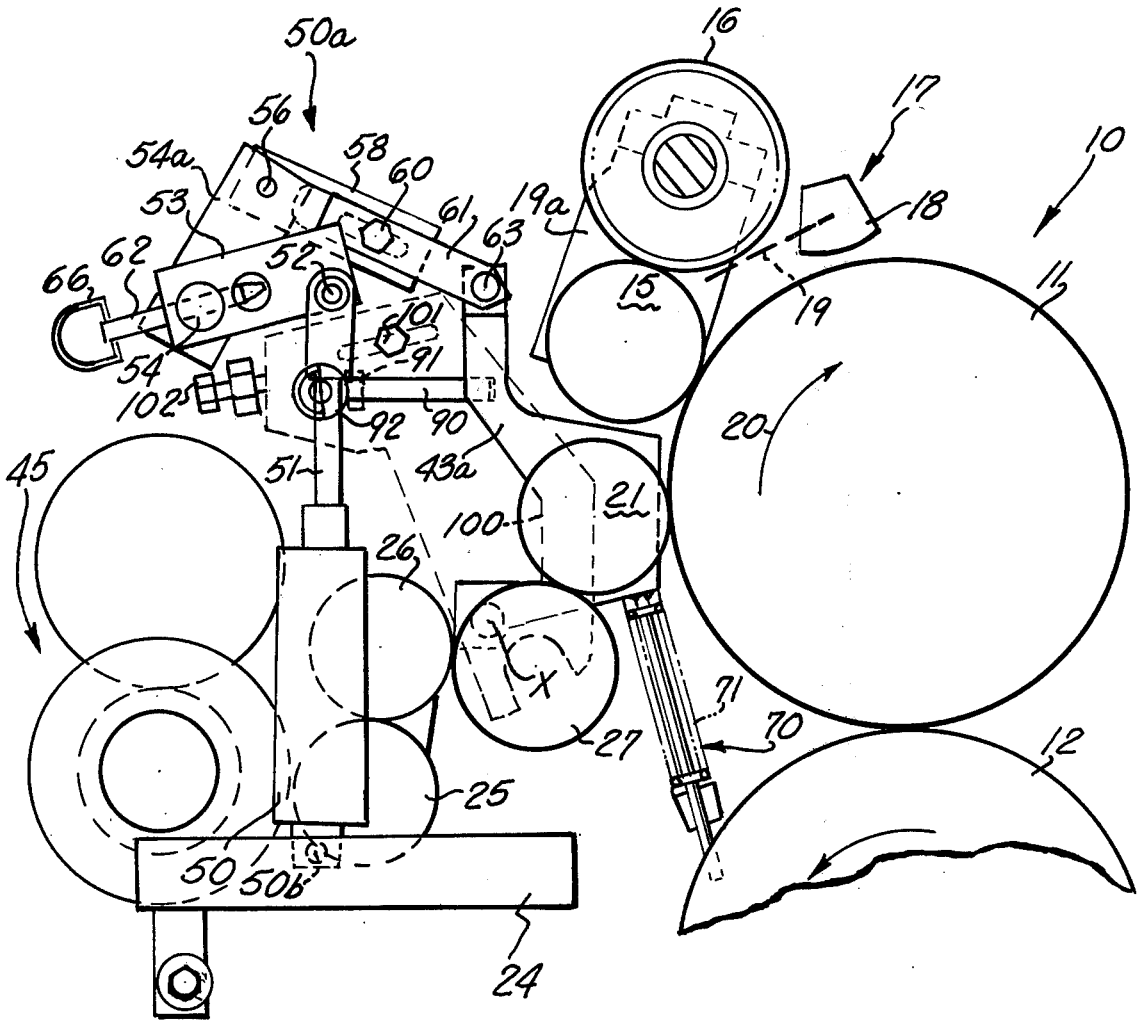
FIG. 1 is a side elevational view in somewhate schematic form of a printing press embodying the present invention.

As shown by the arrow 20 in FIG. 1, the plate cylinder 11 is rotated in a clockwise direction and a dampener form roll 21 applies dampening solution to the plate carried by the plate cylinder 11 prior to the ink form roll 15 applying ink to the plate carried by the plate cylinder 11. The dampener form roll is made of a suitable composition and is a resilient non-absorbent roll. The dampener form roll 21 is shown in full lines in FIG. 1 in its thrown-on position for transferring dampening solution to a plate on the plate cylinder 11.

The dampener form roll 21 receives dampening solution from a pan 24. The dampening solution is transferred from the pan 24 by a pan roll 25 to a metering or slip roll 26. The metering or slip roll 26 transfers the dampening solution to a vibrator roll 27 which in turn transfers the dampening solution to the dampener form roll 21. The vibrator roll 27 is a suitable hydrophilic chrome roll, or hard surface roll, and a suitable mechanism is provided for vibrating the vibrator roll longitudinally of or parallel to its axis. The vibrator roll runs in fluid transferring relationship with the dampener form roll 21.

Figure 2:
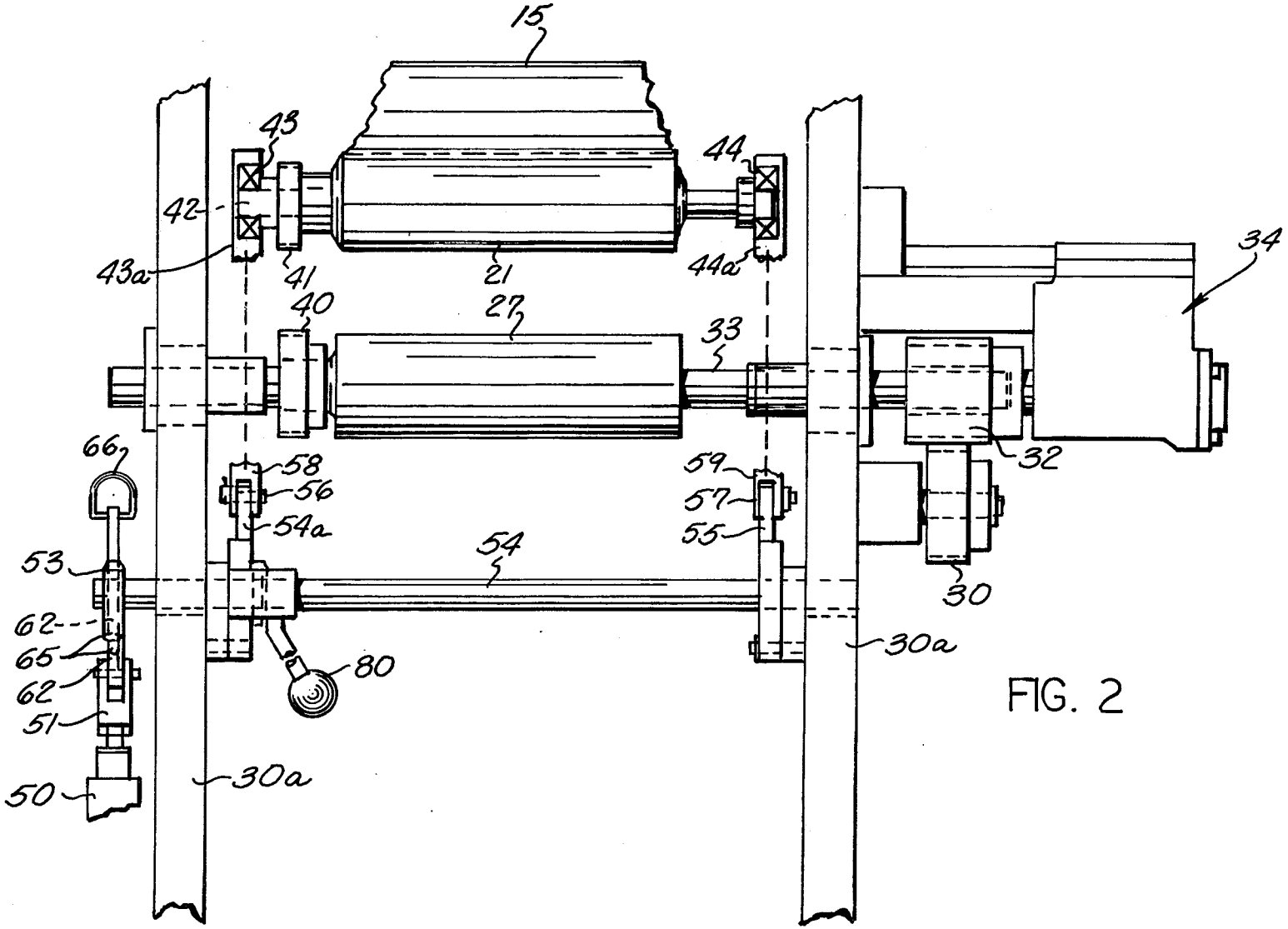
FIG. 2 is a somewhat schematic plan view, showing parts in a somewhat exploded position for purposes of illustration.

The vibrator roll 27, as best shown in FIG. 2, is rotated by an idler gear 30 which runs in meshing engagement with a gear (not shown) carried by and rotatable with the plate cylinder 11. The idler gear 30 is supported by the frame 30*a* of the dampener. The gear 30 meshes with a gear 32 carried on the axis or shaft 33 of the vibrator roll 27. The machanism for moving the roll 27 axially is shown schematically at 34 in FIG. 2. The mechanism will not be described in detail since it does not form a part of the present invention. On vibration of the vibrator roll 27, the gear 32 moves axially with the vibrator roll 27 and the teeth of the gear 32 slide relative to the teeth of the gear 30.

On the left end (as shown in FIG. 2) of the shaft 33 of the vibrator roll 27, there is a further gear 40 which meshes with gear 41 fixedly carried on the dampener form roll shaft 42. The gear 41 drives the dampener form roll 21. The opposite ends of the shaft 42 of the dampener form roll 21 are supported in bearings 43, 44, respectively, mounted in hangers 43*a,* 44*a,* respectively. The hangers 43*a,* 44*a* are supported for pivotal movement relative to the frame 30*a* of the dampener about an axis X, shown in FIG. 1.

The pan roll 25 of the dampener is driven from a suitable variable speed motor through suitable gearing 45. The metering roll 26 is gear driven by a gear (not shown) carried on its shaft which meshes with a driving gear (not shown) on the shaft of the pan roll 25. The pan roll 25 and metering roll 26 are driven at a variable speed, depending upon the adjustment of the variable speed motor which effects the drive thereof. The use of a variable speed motor 45 for driving the pan and metering rolls is well known and the drive arrangement to these rolls will not be described in detail.

It should be understood that the pan and metering rolls are driven at an adjustable speed which is different than the speed of the vibrator and dampener form roll. Thus slip occurs at the nip between the metering roll 26 and the vibrator roll 27.

The methering roll 26 is adjustable toward and away from the axis of the pan roll 25 for purposes of adjusting the nip between the pan roll 25 and the metering roll 26. Likewise a skew adjustment may be provided, not shown, for the pan roll 25 for purposes of skewing the axis of the pan roll 25 relative to the axis of the metering roll 26 for purposes that are well known. Further, the metering roll 26 may be moved for purposes of adjustment toward and away from the axis of the vibrator roll 27, and again this adjustment will not be described in detail for purposes of simplicity of the disclosure, since such adjustment is well known.

Figure 3:
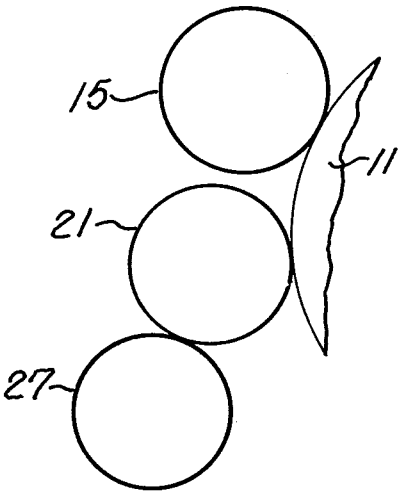
FIGS. 3, 4, and 5 are schematic views illustrating the various positions of the rolls in the present embodiment.
Figure 4:
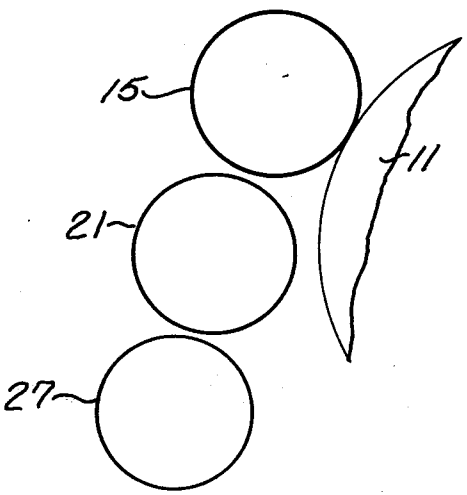

As noted above, in accordance with the present invention, the dampener form roll has three positions, namely, the full line position shown in FIGS. 1 and 3 in which it is in dampening solution transferring relationship with a plate on the plate cylinder 11; the position shown in FIG. 4, in which the dampener form roll is located in a thrown-off position in which it is out of engagement with the plate on the plate cylinder, but yet which is likewise spaced from the ink form roll 15; and a third position, or wash-up position, in which the dampener form roll is in fluid-transmitting relationship with the ink form roll 15 when the ink form roll 15 is in its thrown-off position as shown in FIG. 5.

The dampener form roll is moved between its thrown-on and thrown-off positions by a suitable motor, designated 50 and a linkage 50*a* interposed between the motor 50 and the dampener form roll 21. The motor 50 is a suitable air cylinder which has a reciprocating output member 51 which is pivotally connected at 52 to a link 53. The link 53 is carried on a shaft 54. The shaft 54 extends across the frame 30*a* of the dampener and is supported at its opposite ends by the frame 30*a* for rotary movement relative to the frame 30*a* of the dampener, as best shown in FIG. 2. The shaft 54 carries a pair of horizontally spaced links 54, 55 located at opposite ends thereof adjacent the opposite sides of the frame 30*a* of the dampener. The links 54, 55 are pivotally connected at 56, 57, respectively, to links, 58, 59, respectively. Each link 58, 59, respectively, is connected by an adjustable connection 60 to a further link 61. Only one of the connections 60 and links 61 are shown.

The adjustable connections 60, comprise a slot in link 58, 59 which slidably receive links 61 respectively and bolts which secure the links 61 in any position within the slots in the links 58, 59, respectively. By this adjustment the pressure relationship between the form roll 21 and plate on the plate cylinder 11 can be adjusted.

The links 61 are pivotally connected at 63 to the hangers 43*a,* 44*a* which support the bearings 43, 44 of the dampener form roll 21. Accordingly, it should be apparent from the above, that upon actuation of the motor 50 the linkage 50*a* is operated such that the dampener from roll 21 will be moved between its thrown-on and thrown-off positions depending upon the direction of actuation of the motor 50. The motor 50 is pivotally attached to the frame of the dampener as 50*b*, as shown in FIG. 1.

In accordance with the present invention, the linkage 50*a* between the output member 51 and the dampener form roll 21 comprises a means for transmitting the motion from the output member 51 of the motor 50 to the dampener form roll 21 to effect movement of the dampener form roll 21.

In accordance with the present invention, the linkage 60 may be disconnected and rendered inoperative to transmit the output motion of the motor 50 to the dampener form roll 21. This disconnection is effected by a suitable means. In the preferred embodiment this means comprises a pin 62 which is interposed in the linkage 50*a* between the link member 53 and the shaft 54. The pin 62 has spring-biased detents not shown which hold the pin in position and which secure the link 53 to the shaft 54. However, by pulling the pin 62 by manually gripping the handle 66 on the pin and pulling the pin from the shaft 54, the shaft 54 becomes disconnected from the link 53.

Figure 3A:
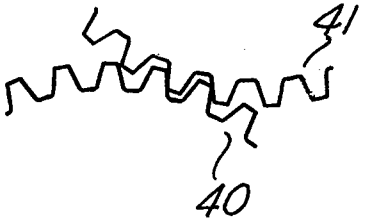
FIGS. 3A, 4A, and 5A are schematic views illustrating various positions of the gear on the shaft of the dampener form roll when the dampener form roll is in positions as illustrated in FIGS. 3, 4, and 5, respectively.
Figure 4A:
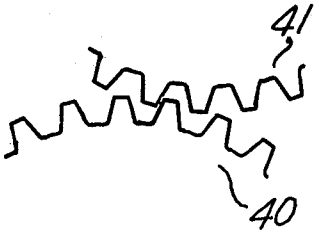

When the pin 62 is pulled the dampener form roll 21 is moved to its wash-up position by a spring arrangement 70. The spring arrangement 70 specifically acts on the hangers 43*a*, 44*a* which support the bearings 43, 44 of the dampener roll 21. The spring arrangement 70 moves the dampener form roll 21 to its wash-up position into engagement with the ink form roll 15 when the ink form roll is in its thrown-off position. The spring arrangement 70 may take a variety of different forms but includes a coil spring 71 which moves the dampener form roll. The spring 71 actually moves the dampener form roll 21 into a position where the gear teeth of the gear 41 come out of meshing engagement with the gear teeth on the gear 40. This is best illustrated in FIGS. 3A–5A. In FIG. 3A the gear teeth on the gear 41 are in mesh with the gear teeth on the gear 40 and the dampener form roll 21 is in its thrown-on position for applying dampening solution to the printing plate. In FIG. 4A, the gear teeth on the gear 41 are only partially in mesh, rather than completely in mesh, as in FIG. 3A with the gear teeth on the gear 40. In this position, the thrown-off position, the dampener form roll 21 is out of engagement with the plate on the plate cylinder and not applying dampening solution to the plate as shown in FIG. 4. However, the gear teeth are sufficiently in mesh in order to effect a drive to the dampener form roll 21 from the plate cylinder 11 when the dampener form roll is in its thrown-off position, as is well known and for conventional reasons. However, as shown in FIG. 5, when the dampener form roll is moved by the spring 71 to its wash-up position, the gear teeth on the gear 41 are moved completely out of engagement with the gear teeth on the gear 40, and thus the dampener form roll 21 in this position is free to rotate with the ink form roll 15 due to its surface pressure engagement with the ink form roll 15, which is in its thrown-off position.

When the dampener form roll 21 is in the position shown in FIG. 5, the dampener form roll is driven by the surface pressure contact with the ink form roll 15 and accordingly, if wash-up solution is applied to the inker, the dampener form roll 21 is likewise washed with the wash-up of the inker, all as should be well understood by those skilled in the art.

When it is desired to move the dampener form roll 21 from its wash-up position back into operative engagement after wash-up, the bias of the spring 71 must be overcome. Accordingly, a handle 80 is provided which is fixed to the shaft 54. The handle 80, when moved in the appropriate direction, overcomes the bias of the spring 71 and moves the dampener form roll 21 through the action of the parts of linkage 50*a* located between shaft 54 and hangers 43*a*, 44*a* against the bias on the form roll 21 toward its thrown-off position. As the dampener form roll 21 moves back to its thrown-off position, the dampener form roll 21 may be spun manually on its axis in order to cause the gear teeth of the gear 41 to be properly aligned with the gear teeth on the gear 40. When these gear teeth are properly aligned, the handle 80 is moved so as to positively bring the gears 40, 41 into proper meshing relationship for purposes of re-establishing the gear drive between the gears 40, 41. When the drive is re-established, the location of the openings for pin 62 in the shaft 54 and link 53 will be aligned so that the pin 62 may be reinserted therethrough in order to interconnect the shaft 54 and the link 53. When the pin 62 is reinserted, the linkage 50*a* is reconnected and restored to its original position where it is now capable of transmitting the output force from the motor 50 in order to effect movement of the dampener form roll between its thrown-on and thrown-off positions.

The form roll 21, and particularly the hangers 43 and 43*a* for the form roll 21 are pivotally supported by hangers 100 located on opposite sides of the dampener and only one of which is shown in FIG. 1, and will be described. The axis of relative pivotal movement of hangers 100 and hanger 43*a* is axis X about which the form roll 21 is moved to its various positions. The hanger 100 is also supported for pivotal movement about the axis of the vibrator roll 27. The hanger 100 pivotally supports a cam member 92, which may be moved between solid and dotted line positions, shown in FIG. 1. The cam member is located in its solid line position shown in FIG. 1 when the dampener form roll 21 is moved to its wash-up position.

Further, the bracket 100 is releasably secured to the frame of the dampener by a screw 101 which extends through a slot in the bracket 100 and into a tapped opening in the frame of the dampener. When the screw 101 is loosened, the bracket 100 can move relative to the frame of the dampener about the axis of the vibrator roll 27.

In order to effect adjustment of the pressure between the form roll 21 and the vibrator roll 27, the cam member 92 is moved into its dotted line position shown in FIG. 1 where it lies adjacent the head of a screw 90 which projects from the hanger 43*a*. The screw 90 is then turned with the screw 60 loosened and screw 101 tightened. As a result, the dampener form roll 21 moves into a greater or lesser pressure relationship with the vibrator roll 27 depending upon the direction of movement of the screw 90.

In order to adjust the pressure of the dampener form roll 21 relative to the plate cylinder 11, both the bracket 100 and the hanger 43*a* are moved as a unit. This is effected by loosening the screws 60 and 101 and adjusting the screw 102 which is threaded into a portion secured to the frame and which abuts the bracket 100. By adjustment of the screw 102 toward the bracket 100, the bracket 100 moves and the cam 92 effects movement of the screw 90 which causes simultaneous adjustment of the brackets 100 and 43*a* about the axis of the vibrator roll 27. Adjustment of the screw 102 away from the bracket 100 results in spring 70 moving the form roll 21 away from the plate cylinder 11. In any event, movement of the screw 102 results in a change in the pressure relationship between the form roll 21 and the plate cylinder 11.

From the above, it should be apparent to those skilled in the art that the present invention is novel and unique and it is intended by the appended claims to cover modifications in the illustrated embodiment which incorporate the present invention.

Having described my invention, I claim:

1. Apparatus for use in a lithographic printing press having a plate cylinder for carrying a printing plate and an inker having at least one ink form roll for applying ink to the printing plate, said apparatus comprising a dampener form roll for applying dampening solution to the printing plate, said dampener form roll having a thrown-on position for transferring dampening solution to a plate, a thrown-off position out of dampener solution transferring relationship with a plate and a wash-up position in fluid-transmitting relation with an ink form roll of the inker, a throw-off mechanism for moving said dampener form roll between said thrown-on and thrown-off positions including a motor and a linkage mechanism interconnecting said motor and said dampener form roll, means in said linkage mechanism for selectively connecting or disconnecting said linkage mechanism, and at least one spring for moving said dampener form roll to said wash-up position upon disconnection of said linkage mechanism.

2. A dampener as described in claim 1 wherein said motor has a reciprocable output member connected with said linkage mechanism and said linkage mechanism includes a link associated with said output member and a rotatable shaft, said means for selectively connecting or disconnecting said linkage mechanism comprises means for releasably connecting said link and said shaft.

3. Apparatus comprising a plate cylinder for carrying a lithographic printing plate, an inker having at least one ink form roll for applying ink to the printing plate, a dampener form roll for applying dampening solution to the printing plate, said dampener form roll having a thrown-on position for transferring dampening solution to a plate, a thrown-off position out of dampener solution transferring relationship with a plate and a wash-up position in fluid-transmitting relation with an ink form roll of the inker, a throw-off mechanism for moving said dampener form roll between said thrown-on and thrown-off positions includng a motor and a linkage mechanism interconnecting said motor and said dampener form roll, means in said linkage mechanism for selectively connecting or disconnecting said linkage mechanism, drive means for rotating said dampener form roll including a pair of meshing gears, one of which is connected with said dampener form roll and moves therewith upon movement of said form roll between said positions, and at least one spring for moving said dampener form roll to said wash-up position upon disconnection of said linkage mechanism and for moving said gears out of meshing engagement when said dampener form roll is moved to its wash-up position.

4. Apparatus as described in claim 3 wherein said motor has a reciprocable output member connected with said linkage mechanism and said linkage mechanism includes a link associated with said output member, a rotatable shaft, and a selectively removable member releasably connecting said link and said shaft and comprising said means for selectively connecting or disconnecting said linkage mechanism.

5. Apparatus as defined in claim 4 wherein said link and said shaft have openings therein and said member comprises a pin extending through said openings to connect said link and shaft and which is removable from said openings to disconnect said linkage mechanism.

6. Apparatus for use in a lithographic printing press having a plate cylinder for carrying a printing plate and an inker having at least one ink form roll for applying ink to the printing plate, said apparatus comprising a dampener form roll for applying dampening solution to the printing plate, said dampener form roll having a thrown-on position for transferring dampening solution to a plate, a thrown-off position out of dampener solution transferring relationship with a plate and a wash-up position in fluid-transmitting relation with an ink form roll of the inker, a throw-off mechanism for moving said dampener form roll between said thrown-on and thrown-off positions including a motor and a linkage mechanism interconnecting said motor and said dampener form roll, means in said linkage mechanism for selectively connecting or disconnecting said linkage mechanism, at least one spring for moving said dampener form roll to said wash up position upon disconnection of said linkage mechanism, and drive means for rotating said dampener form roll including a pair of meshing gears, one of which is connected with said dampener form roll and moves therewith, and said spring acts to move said gears out of meshing engagement when said dampener form roll is moved to its wash-up position.

7. Apparatus for use in a lithographic printing press having a plate cylinder for carrying a printing plate and an inker having at least one ink form roll for applying ink to the printing plate, said apparatus comprising a dampener form roll for applying dampening solution to the printing plate, said dampener form roll having a thrown-on position for transferring dampening solution to a plate, a thrown-off position out of dampener solution transferring relationship with a plate and a wash-up position in fluid-transmitting relation with an ink form roll of the inker, a throw-off mechanism for moving said dampener form roll between said thrown-on and thrown-off positions including a motor and a linkage mechanism interconnecting said motor and said dampener form roll, means in said linkage mechanism for selectively connecting or disconnecting said linkage mechanism, and at least one spring for moving said dampener form roll to said wash-up positive upon disconnection of said linkage mechanism, said motor having a reciprocable output member connected with said linkage mechanism, said linkage mechanism including a link associated with said output member and a rotatable shaft, said means for selectively connecting or disconnecting said linkage mechanism comprises means for releasably connecting said link and said shaft, said link and said shaft having openings therein and said means for selectively connecting or disconnecting said link and shaft comprises a pin extending through said openings to connect said link and shaft and which is movable from said openings to disconnect said linkage mechanism.

* * * * *

UNITED STATES PATENT AND TRADEMARK OFFICE

CERTIFICATE OF CORRECTION

PATENT NO. : 4,036,131
DATED : July 19, 1977
INVENTOR(S) : Donald Fenton Elmore

It is certified that error appears in the above-identified patent and that said Letters Patent are hereby corrected as shown below:

Column 8, line 51 change "positive" to --position--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*